United States Patent [19]

Morgan

[11] Patent Number: 5,021,765

[45] Date of Patent: Jun. 4, 1991

[54] SECURITY SYSTEM HAVING DETECTOR MEANS SENSITIVE TO THE PROXIMITY OF AT LEAST ONE DETECTED OBJECT

[75] Inventor: Barry A. Morgan, Tintagel, England

[73] Assignee: Transaqua Technology Limited, United Kingdom

[21] Appl. No.: 346,392

[22] Filed: May 1, 1989

[30] Foreign Application Priority Data

May 7, 1988 [GB] United Kingdom ..... 8810872

[51] Int. Cl.[5] ..... G08B 21/00

[52] U.S. Cl. ..... 340/539; 340/572; 340/573

[58] Field of Search ..... 340/539, 573, 572

[56] References Cited

U.S. PATENT DOCUMENTS 4,212,002 7/1980 Williamson ..... 340/572

4,308,530 12/1981 Kip et al. ..... 340/572

*Primary Examiner*—Glen R. Swann, III

*Attorney, Agent, or Firm*—Needle & Rosenberg

[57] ABSTRACT

A security system suitable for monitoring the presence of the occupants of a vessel such as a sailing yacht has two receivers at fixed locations on the yacht for receiving signals from one of a number of transmitters each worn by a respective crew member. The receivers are connected to a detector having a comparator triggered when a predetermined relative signal strength is generated by the receivers indicating the presence of a transmitter in an "unsafe" region acting to cause triggering of an alarm and automatic ejection of a life buoy or other life saving equipment.

14 Claims, 5 Drawing Sheets

SECURITY SYSTEM HAVING DETECTOR MEANS SENSITIVE TO THE PROXIMITY OF AT LEAST ONE DETECTED OBJECT

BACKGROUND OF THE INVENTION

In many security systems there is a general requirement to be able to monitor the position and/or status of one or more surveillance targets or objects. In the marine security application which will be particularly described in more detail hereinafter, the surveillance targets or "objects" may be the crew members on board a yacht, with the object of surveillance being to monitor that all crew members are safely on board, responding to a crew loss event by generating a "man overboard" signal and initiating the operation of sophisticated survival and retrieval equipment.

In other applications the surveillance "objects" may be animate or inanimate and the nature of the monitored event may be one of a number of different possibilities depending on the particular circumstances. For example, if the "object" under surveillance is a case carrying cash or valuables, the "event" may be release of the carrying handle by an authorised operator. This event may be perfectly normal, for example during the everyday handling of the case, placing it on a counter or in a motor vehicle for transport, but may be an alarm "event" in that the handle may only be released by the operator because it has been forced from his grasp by thieves. In order to distinguish between "normal" and "alarm" events the system of the present invention incorporates position monitoring or surveillance equipment operable to trigger appropriate alarm equipment when an alarm event is detected.

In such surveillance monitoring situations there is an essential requirement to conserve the power of an electrical supply since this is usually very limited and required to remain active over an extended period of time. For example, on board a yacht there is only a very limited supply of electricity, either from a small generator or from storage batteries, and opportunities for recharging the batteries are often severely limited by the weather. For this reason electrical systems avoiding a constant current drain at least in some of their parts have considerable advantages.

In the above indicated application of a security system for monitoring the crew on a boat one physical phenomenon which is available for detection to trigger a "man overboard" indication would be immersion in water since this is an inevitable corollary to falling overboard. However, the crew of a boat, particularly a sailing yacht, are frequently entirely saturated even when performing their normal duties on board in inclement weather and it would be counter productive if the saturation of any sensor carried by the crew caused spurious alarm indication. Indeed, there is a risk that this may result in the crew inhibiting the operation of the alarm sensors in just those conditions in which they are most likely to be required. For this reason the specific embodiment of the security system of the present invention described hereinafter incorporates position discrimination means in combination with a water immersion sensor to produce an output alarm indication only upon coincidence of the water-triggered alarm sensor and detection of the signal from a position remote from the vessel.

OBJECTS OF THE INVENTION

It is an object of the present invention to provide a security system having an alarm sensor which, although it may be triggered by saturation of a crew member on the deck this will not result in an alarm indication because the position discrimination system will not provide the necessary coincidence signal.

It is another object of the invention to provide a system in which the coincidence of position discrimination means and one or more other alarm event sensors are utilised to distinguish between an alarm event which requires the system to be activated and an event which is not an alarm event.

SUMMARY OF THE INVENTION

According to one aspect of the present invention, therefore, there is provided a security system having detector means sensitive to the proximity of at least one detected object, the detector means being operable to generate an alarm indication if the detected object is located in a first region in the vicinity of the detector means and not if the object is in a second region in the vicinity of the detector means.

It is important for its application as a marine security system that the said first region within which an alarm event will cause activation of the system be close to the detector means since speed of response is essential in enabling certainty of rescue. If a system which merely detected the absence of a signal from a crew member or the gradual fading of such a signal as the separation between the crew member having fallen overboard and the yacht increases there would be a decreasing prospect of subsequently locating and rescuing the man overboard or of launching a support buoy for assistance with survival and location.

It would, of course, be possible to use a system in which the detected object provides a signal by reflection, for example by supplying crew members with reflective jackets, but in order to provide adequately short response times it would be necessary to maintain an accurate monitoring of the number of reflections and in circumstances where these may change in position around the boat rapidly very sophisticated tracking and monitoring computation would be required making such a system prohibitively expensive.

The present invention overcomes this problem by making the detected object itself sensitive to a physical phenomenon and responsive to that phenomenon to cause the production of signals to which the detector is sensitive. In this way the detected object is normally passive in the sense that no signals pass between the objects being monitored and the detector, although the detector must be continuously sensitive to the reception of signals from the monitored objects. The physical phenomenon may be one of any number of physical quantities for which sensors are available. In the present example of a marine security system the physical phenomenon is saturation, or rather immersion, in water, although the same effect could be achieved by detecting relative humidity with a sensor operating to produce an output signal when the humidity level approaches 100%. In alternative systems for maintaining security of objects under surveillance in different circumstances the physical phenomenon may be temperature, pressure, electrical or magnetic fields or signals, electromagnetic waves, atomic radiation etc. It is to be understood that the above list is exemplary and not exhaustive.

In the case of a marine security system the detected object may be a transmitter small enough to be carried about the person and operable to transmit signals only when immersed in water or saturated sufficiently to complete an electrical circuit for this purpose. Since it may have to transmit signals from a position under water the nature of the transmitted signals is important. It is presently envisaged that the most appropriate signals for transmission are radiated electromagnetic signals at a relatively low frequency.

Although it will work at higher frequencies it is preferred that such a transmitter includes an electromagnetic inductor tuned to a carrier frequency less than 100 KHz. Above this value there are transmission losses due to the water if the transmitter is submerged, although it would be possible to use a carrier frequency up to about 300 KHz although at these higher frequencies increasing power is required in order to transmit through water a signal of sufficient strength to be detectable. The lower frequencies indicated above are preferred in the specific embodiment because of the fact that the transmitters are small, portable, and battery powered, and therefore there is a severe limitation on the size and weight of the power supply. Below about 26 KHz it is harder to achieve radiation without increasing sophistication of the transmitter and thus increased cost.

In order to achieve position discrimination the detector means of the security system preferably include two sensors at spaced locations, the said first and second regions being determined by the relationship between the relative positions of the sensors and the relative sensitivity of respective channels through which signals generated thereby are processed.

The sensors may be magnetic induction pick ups and the transmitter a resonated magnetic inductor. Signals transmitted in this way can pass equally well through water or air but are limited to a relatively short range: however, in the circumstances of use envisaged herein a short range, typically of the order of ten meters, is adequate providing the triggering sensitivity of the system is sufficiently high to be certain to cause the security system to be activated as the transmitter passes through a ten meter wide activation zone.

Especially for use as a marine security sensor the magnetic induction pick up preferably includes three magnetic inductors mutually orthogonally orientated so as to detect with greatest sensitivity any signals generated by a transmitting inductor regardless of its orientation. Such a pick up necessarily requires means for producing an output signal in response to signals induced in any one or any combination of the inductors.

In such a system a first sensor channel preferably generates a first maximum output signal when the transmitter is within a first radial distance therefrom and the second sensor channel generates a second maximum output signal when the transmitter is within a second radial distance therefrom, the said first maximum output signal being greater than the said second maximum output signal and the sensitivity of the said second sensor channel being greater than that of the first sensor channel.

Upon activation of the security system the response mechanism may include launching of a safety buoy and/or triggering of an audible and/or visible alarm. By launching a safety buoy automatically and almost immediately upon triggering of the alarm the chances of recovery of a man overboard are significantly increased, largely by virtue of the anticipated proximity of the man overboard and the buoy.

The present invention also comprehends, according to a second aspect thereof, a receiver for a security system, having two sensor elements at spaced locations and two separate signal processing channels for processing signals generated by respective sensor elements in response to signals received from a transmitter the position of which is to be monitored, and means for comparing processed output signals from the two channels whereby to determine whether the transmitter is within or outside a first region for initiating an alarm condition if signals are received from the transmitter from within the said first region.

Preferably an alarm indication is generated if the processed output signal from one channel is greater than that from the other.

According to a third aspect of the present invention there is provided a security system having a transmitter and a receiver sensitive to signals transmitted by the transmitter and to the position of the transmitter with respect to the receiver such that when the transmitter is in a first region in the vicinity of the transmitter energisation of an alarm is initiated and when a transmitter is in a second region outside the said first region the alarm indication is inhibited.

Other features and advantages of the invention will become apparent from a detailed study of the following description in which reference is made to the accompanying drawings, provided purely by way of non-limitative example.

DESCRIPTION OF THE PREFERRED EMBODIMENT

Figure 1:
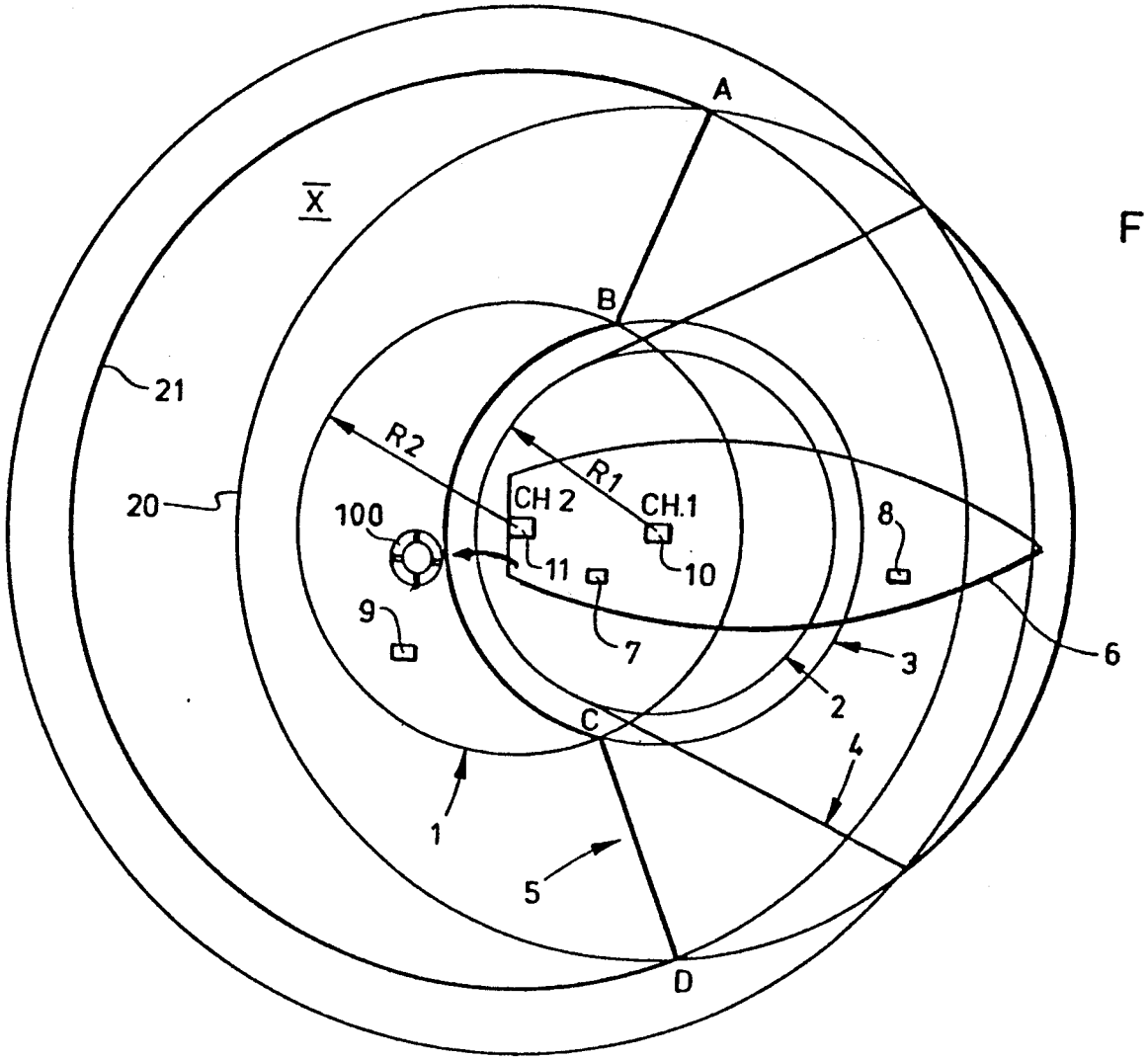
FIG. 1 is a plan view of a boat fitted with a security system in accordance with the principles of the present invention.
Figure 2:
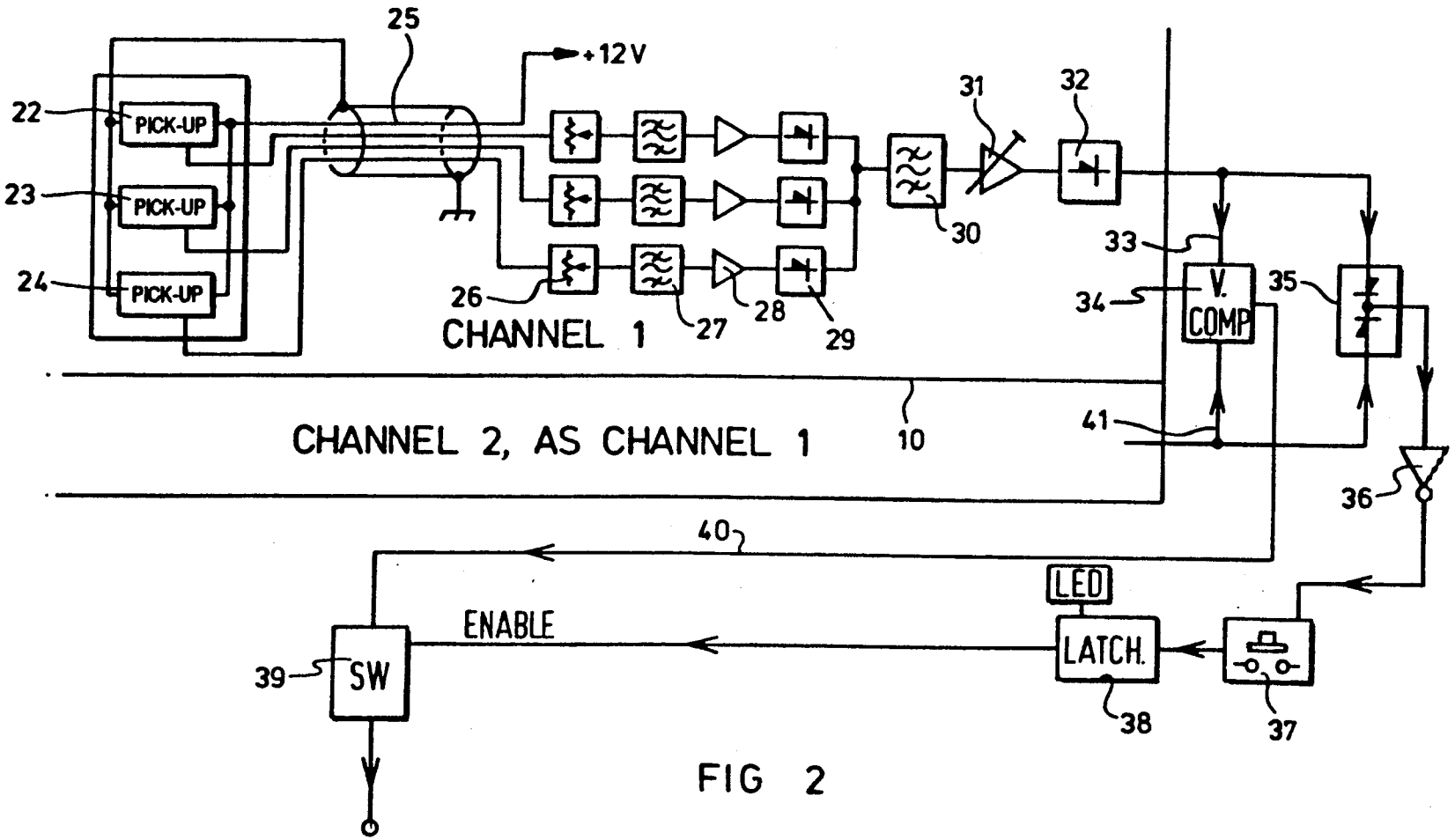
FIG. 2 is a block schematic diagram illustrating a receiver formed as a part of the security system discussed in relation to FIG. 1.

Referring now to the drawings, and particularly to FIGS. 1 and 2 thereof there is shown a vessel in plan generally indicated with the reference numeral 6 provided with two sensors 10, 11 located on the longitudinal centre line of the vessel and spaced from one another such that the first sensor 10 is forward of the second sensor 11. Three crew men are represented by three transmitters 7, 8 and 9 the first two of which are safely positioned on board the vessel and the latter of which is shown in the region somewhat behind the vessel as a man overboard. Each of the transmitters 7, 8 and 9 is designed, in a manner which will be described in more detail hereinbelow, such that it normally uses no current but is activated to transmit electromagnetic signals upon immersion in water. Thus, for example, a crew member in the position of the transmitter 8 handling the foresail may frequently be completely saturated with water so that from time to time his transmitter 8 will generate signals but, as will be discussed hereinbelow, these signals do not result in an alarm indication from the detector system because of the position of the transmitter 8. In the case of the transmitter 9, however, the immersion in water and its position away from the boat are both detected to cause an alarm indication and immediate, automatic, launching of a survival buoy 100 which may form part of the security system: in addition, visual and/or audible alarm indications are raised on the vessel.

Figure 3:
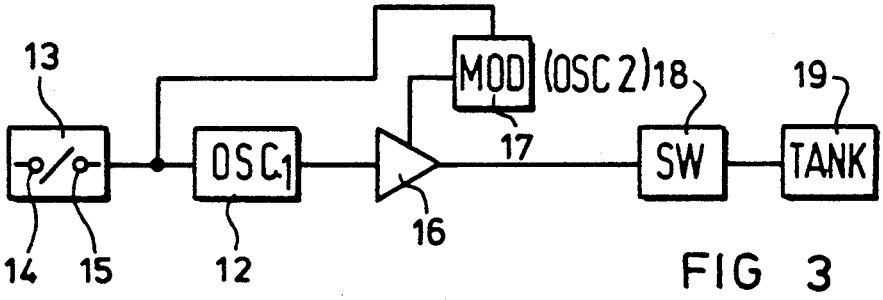
FIG. 3 is a block schematic diagram of a transmitter suitable for use with the security system of the present invention.

With particular reference to FIG. 3, the block schematic diagram shown illustrates the form of the transmitters such as 7, 8 and 9. This comprises an oscillator 12 the input circuit to which includes a sensor 13 incorporating two electrodes 14, 15 across which a potential difference is maintained but which are in an open circuit configuration when dry and across which current leakage takes place upon immersion. Typically, the electrodes 14, 15 may be formed as contact terminals projecting into a cavity in or passageway passing through the casing within which the transmitter is housed so that water must fill the cavity or passageway before the sensor 13 provides a signal indicating that the transmitter is immersed. Upon immersion, however, the current leakage across the terminals 14, 15 causes energisation of the oscillator 12 the output from which is fed to an amplifier 16. The oscillator 12 typically oscillates at a frequency of 26 to 85 KHz. Preferably a frequency of 56 KHz is chosen to avoid the harmonics of the line output stage of video display units which may cause interference if in the vicinity. The amplifier 16 is modulated by a second oscillator 17 which operates at a lower frequency, typically in the region 25 to 250 hz, which acts as the distinguishing signal of the transmitter modulated onto the carrier constituted by the higher frequency oscillator signal from the oscillator 12. The modulated output from the amplifier 16 is supplied to a switching circuit 18 providing a low impedence drive to a tank circuit 19 including a magnetic inductor which radiates electromagnetic signals. Thus, when the transmitter is immersed in water to complete the circuit between the electrodes 14, 15 of the sensor 13 it will commence to transmit electromagnetic signals of low frequency as will be described in more detail in relation to FIG. 4.

A circle 1 of radius R2 is drawn around the receiver 11 to represent the region within which signals received by the receiver 11 from a transmitter will cause the maximum, saturated response of the receiver. Likewise, a circle 2 of radius R1 is drawn around the receiver 10 again to represent the region within which signals from a transmitter will cause the maximum saturated response: as will be described in more detail hereinbelow the signals produced by the receivers 10, 11 at saturation are set such that the signal from the receiver 10 is greater than the signal from receiver 11, but the sensitivity of the receiver 10 is less than that of the receiver 11, as represented by showing the radius R1 if the circle 2 smaller than the radius R2 of the circle 1 identifying the area within which signals from a transmitter cause saturation of the receiver. Also drawn around the first receiver 10 is a second circle 3 which represents the distance from the receiver 10 where its response to the transmitted signals from a transmitter, having fallen from the maximum saturated value, has reached the same or substantially the same value as the saturated value of the output from the receiver 11. Two further circles 20, 21 represent, respectively, the maximum range of the receivers 10 and 11.

As will be described in more detail below the processing circuit connected to the receivers 10 and 11 acts, when signals from a transmitter 7, 8 or 9 are received, to produce an alarm indication only if the output from the receiver 11 is greater than that from the receiver 10. Thus, at any point within the area defined by the circle 2 the signal from the receiver 10 will be greater than that from the receiver 11 since the maximum, saturated value of the output from the receiver 10 is greater than that from the receiver 11. The area within which a signal from a transmitter will generate a greater signal from the receiver 11 than from the receiver 10 is defined, within the circle 21, by the circle 3 and the intersections between this circle and the circle 1 representing the saturated value of the output from the receiver 11, these intersection points being identified with the reference letters B and C, whilst the intersections A and D between the circles 20 and 21 representing the maximum range of the receivers 10 and 11 identify the furthermost forward points of the area X within which the receiver 11 produces the greater output signal. This area X is thus defined by the line AB, the part of the circle 1 from B to C, the line CD and the part of the circle 21 from D to A. The lines A to B and C to D marked with the reference numeral 5, approximately represent the boundary of the regions between which the signal generated by the receiver 10 is greater (to the right of these lines) than the signal from the receiver 11. The inclined line 4 defines, with the circle 3, the boundary of the region within which the signal from the receiver 10 is certainly greater than that from receiver 11.

In normal sailing conditions, therefore, any saturation of a transmitter 7 or 8 whilst on the vessel 6 or in the water within the region bounded by line 4 or circle 3, will result in the receiver 10 generating a greater signal than the receiver 11 and the detector circuits will therefore produce no response. If a signal is received from the area X, however, the receiver 11 will produce a greater signal than the receiver 10 and the detector will automatically trigger an alarm signal and launch the rescue buoy.

Referring now to FIG. 2, the block schematic diagram illustrates the formation of one channel constituting the receiver 10 and its connections to the detector circuits which appropriately determine that a signal is received from both receivers and the relative levels of these signals to determine whether or not to trigger an alarm signal. The receiver 10 comprises three electromagnetic pick ups 22, 23, 24 each orientated orthogonally with respect to the other two so as to produce a maximum sensitivity regardless of the orientation of the inductor of the tank circuit of the oscillator. The three output signals are transmitted by a screened cable 25 to sets of three gain control units 26, three filters 27, three amplifiers 28 and three detector units 29 the outputs of which are connected together to a band pass filter 30 feeding a gain controlled amplifier 31 the output from which is rectified by a rectifier 32 to produce a DC signal the magnitude of which is determined by the proximity of the transmitter to the receiver. This signal is supplied on a line 33 to a voltage comparator 34 and, via a further rectifier circuit 35 and an inverter 36 to a switch 37 and latch 38 which act to enable a switching circuit 39 to produce an output in dependence on the output signal, supplied on a line 40 from the comparator 34 the other input of which is supplied on a line 41 from a second receiver channel connected to the receiver 11 and constituted by corresponding components to those described in relation to the receiver 10 and which, therefore, will not be described in detail herein.

Figure 4:
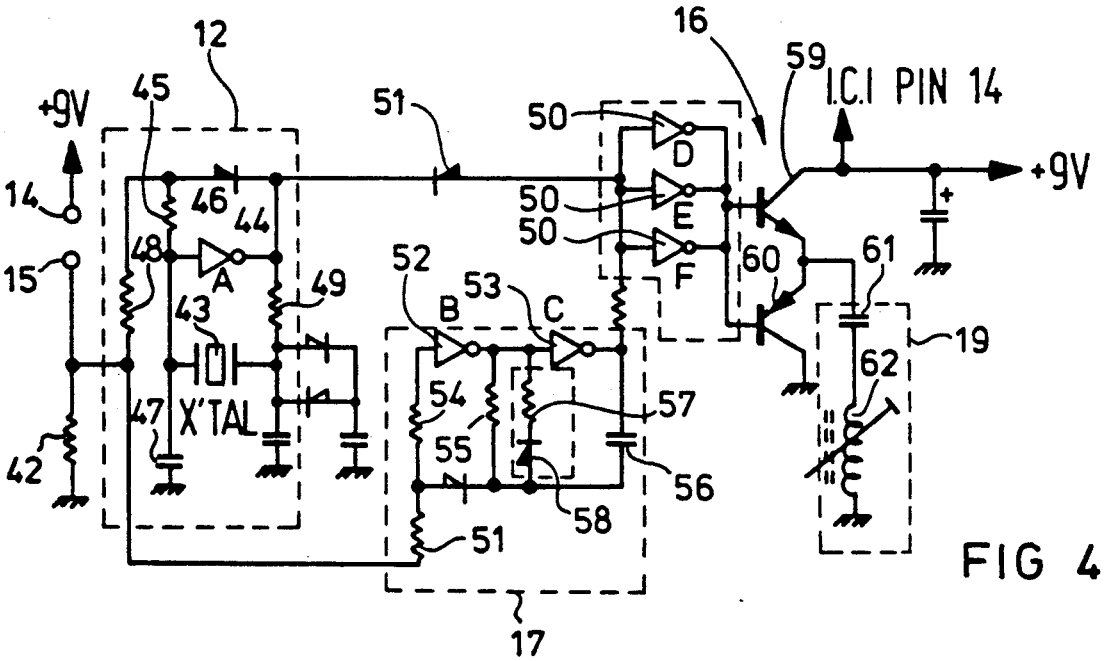
FIG. 4 is a circuit diagram illustrating in more detail the transmitter illustrated in FIG. 3.

The transmitters 7, 8 and 9 are all substantially identical and the typical circuit is illustrated in FIG. 4. With reference to FIGS. 3 and 4 the electrodes 14, 15 of the sensor 13 are shown connected between a positive terminal and a resistor 42 which is earthed.

In the embodiment illustrated the oscillator 12 is composed of a crystal 43 across which is connected a CMOS inverter 44, resistor 45 and diode 46. In alternative embodiments, however, the oscillator may make use of a ceramic resonator or a surface acoustic wave resonator. One terminal of the crystal 43 is trimmed via a capacitor 47 and the oscillator circuit is completed with resistors 48 and 49. This oscillator operates at a frequency of between 25 and 86 KHz and drives the amplifier/output driver constituted by three CMOS inverters 50 via a diode 51. The amplifier/output driver constituted by the CMOS inverters 50 correspond to the amplifier 16 of FIG. 3 and this is keyed by a low frequency oscillator constituted by a resistor 51, inverters 52, 53, resistors 54, 55 and capacitor 56. The series connected resistor 57 and diode 58 reduce the duty cycle to approximately 25% and the amplifier drives a complementary output switch (corresponding to the switch 18 in FIG. 3) constituted by two transistors 59, 60 the emitters of which are connected together and to a tank circuit 19 constituted by a capacitor 61 and inductor 62 which is tuned to the oscillator frequency of the oscillator 12 so as to radiate electromagnetic signals generated by the oscillator 12 as modulated by the oscillator 17.

Figure 5:
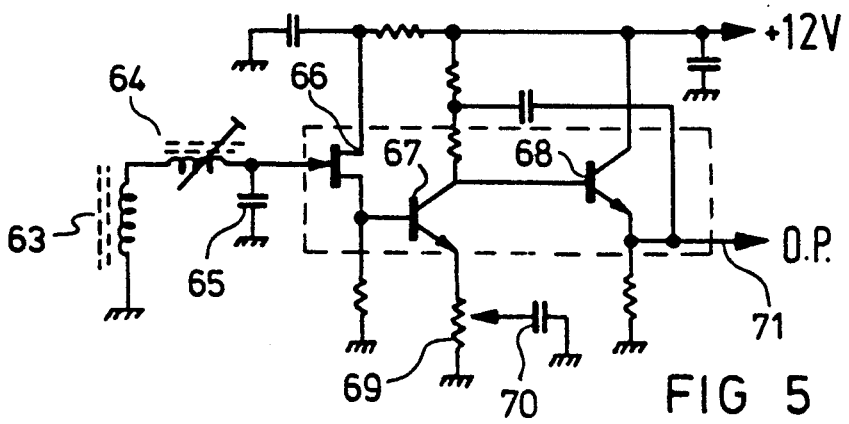
FIG. 5 is a circuit diagram illustrating one pick up suitable for use with the security system of the present invention.

These short range signals are detected by a plurality of magnetic pick ups one of which is illustrated in FIG. 5. Each pick up is composed of three sensing inductors (only one of which is shown in FIG. 5) which, as mentioned above, are aligned mutually orthogonally with one another in order to provide the maximum sensitivity to signals generated by a transmitting inductor 62 regardless of its orientation. The inductor 63 is tuned via a tuning inductor 64 and capacitor 65 and supplies a three stage amplifier constituted by the field effect transistor 66 and two NPN transistors 67, 68 with a gain control constituted by a variable resistor 69 and earthed capacitor 70. The output from the pick up is taken from the emitter of the transistor 68. The gain control effected by the variable resistor 69 allows the performance of each pick up to be standardised upon manufacture. The output from the emitter of the transistor 68 is then taken via the cable 25 (FIG. 2) to the input channel as discussed in relation to FIG. 2, which is shown in more detail in FIG. 6.

Figure 6:
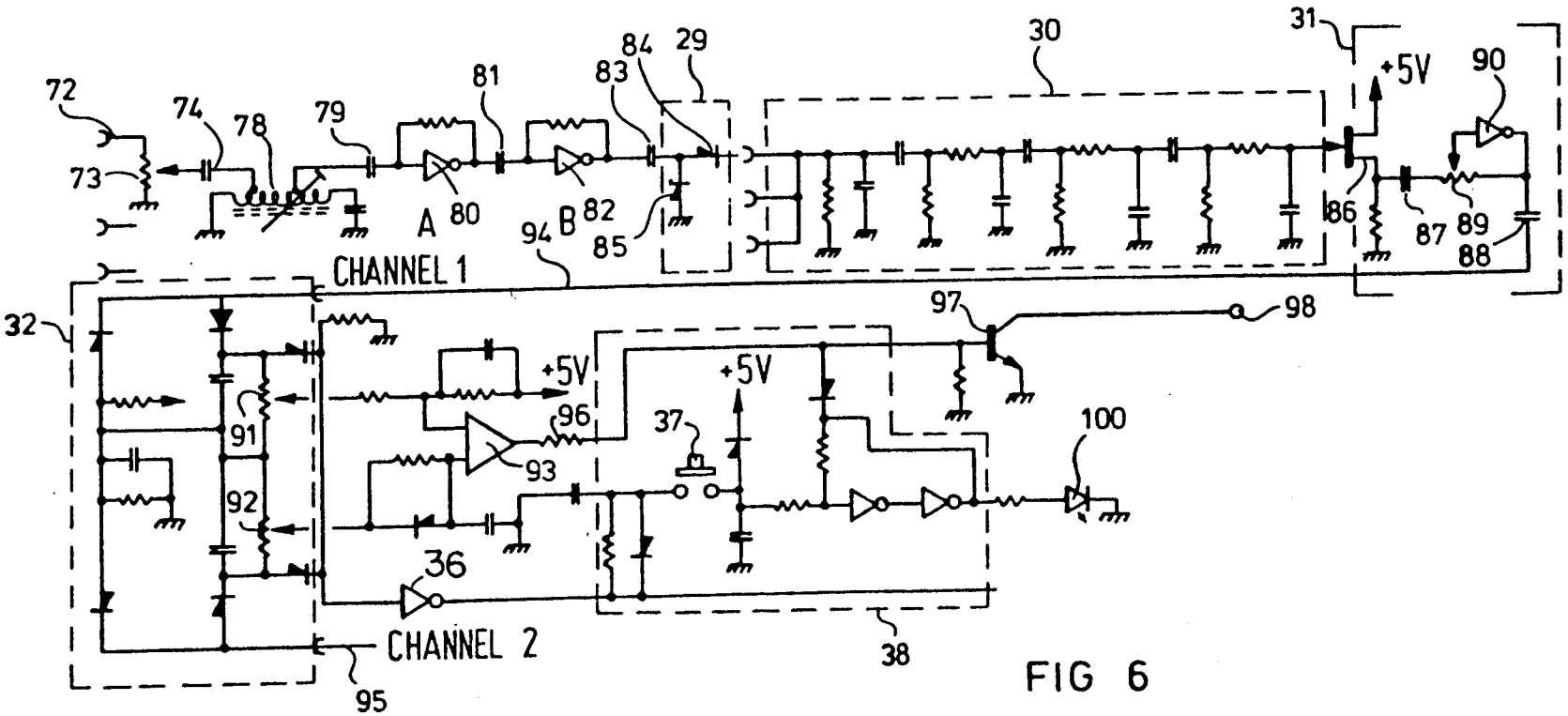
FIG. 6 is a circuit diagram illustrating in more detail one embodiment of the receiver and processing part of the security system of the present invention.

In FIG. 6 the components related only to one pick up are shown, it being appreciated that three sets of such components as illustrated in FIG. 2 are provided, one set for each of the three pick ups of the receiver. It is assumed that the pick up 22 is as illustrated in FIG. 5 and its output is taken on line 71 to terminal 72 of FIG. 6. The input channel processing units constituted by the gain control units 26, low pass filters 27, amplifiers 28 and detectors 29 are constituted by the variable resistor 73 and capacitor 74, by the inductor 78 and capacitor 79, by the inverters 80, 82 with intervening capacitor 81, and by the capacitor 83 and the diodes 84, 85 respectively. At the output of the signal processing channel each signal is connected to the common input of a band pass filter shown within the broken outline 30. The output of the band pass filter, which is tuned to the region of 25–250 hz, represents the signal generated by the low frequency oscillator 17 and this is fed to the gain controlled amplifier 31 constituted by the field effect transistor 86, capacitors 87 and 88, variable resistor 89 and inverter 90. The output signal from the controlled gain amplifier 31 is supplied to a rectifier circuit generally indicated 32 including two variable resistors 91, 92 which respectively feed the inverting and non-inverting inputs of an operational amplifier 93 which acts as a comparator. Adjustment of the resistors 91, 92 adjusts the maximum, saturation value of the signal from the respective receivers signals from one of which are supplied along line 94 from the channel illustrated in detail, and the other of which are supplied along 95 from an identical channel connected to receiver 11 and not illustrated in detail.

When both receivers are driven to saturation by signals transmitted from a transmitter in close proximity, for example within the circle 2 of FIG. 1 the output voltage of the operational amplifier is held low by the input signal from the first channel (receiver 10) the saturation signal from which is determined by the setting of the variable resistor 91. The output from the operational amplifier 93 is fed via a resistor 96 to the base of a switching transistor 97 which constitutes the switch 39 of FIG. 2. The output from transistor 97 is taken from a terminal 98 to control triggering of a buoy-launching circuit (not illustrated). The electronic latch circuit 38 will arm the output via the transistor 97, indicating by a light emitting diode 100. This allows testing of the transmitters without activation of the alarm.

Figure 7:
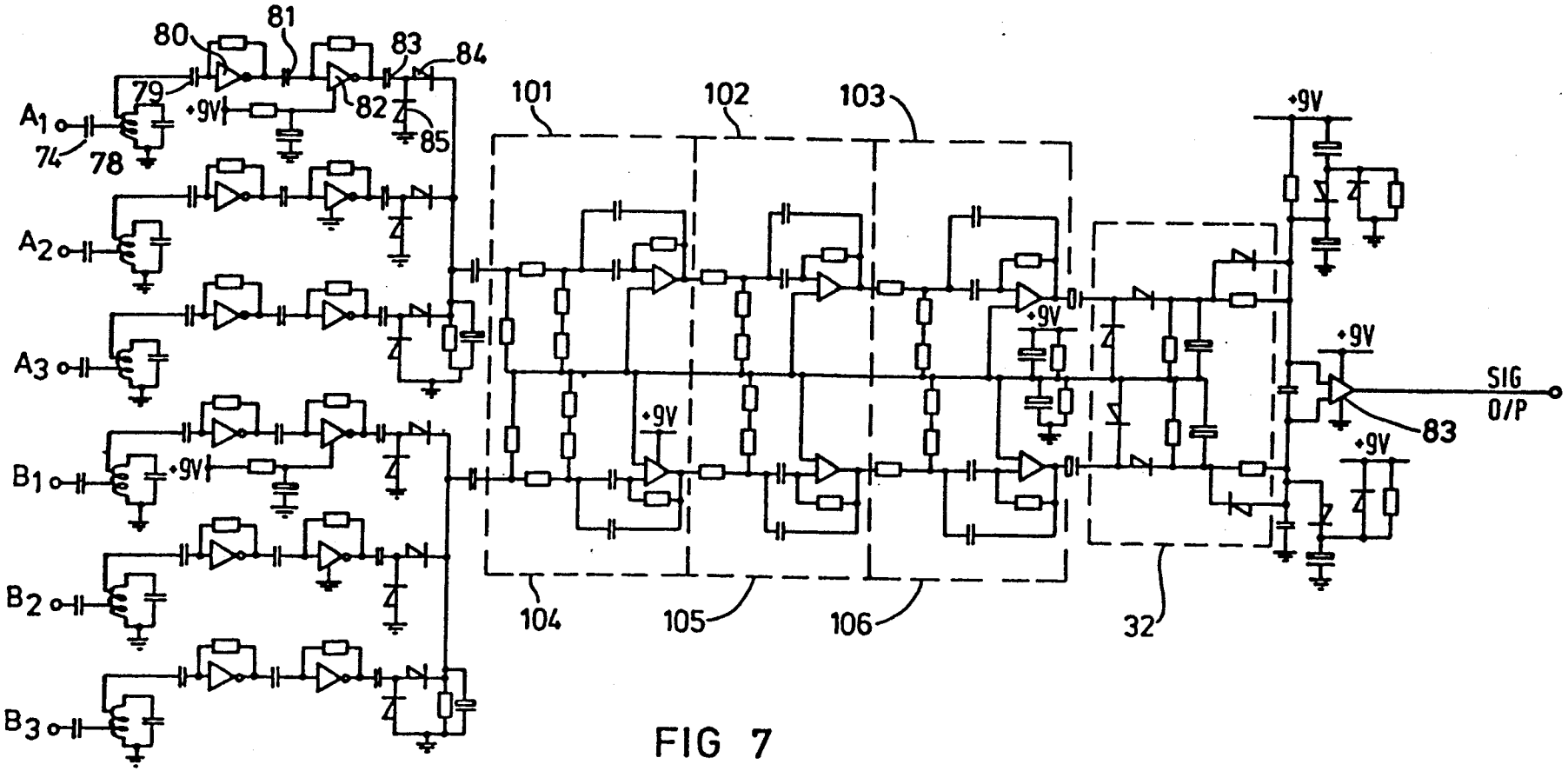
FIG. 7 is a circuit diagram illustrating a second embodiment of the receiver.

FIG. 7 illustrates an alternative embodiment of the receiver shown in FIG. 6, in which the three amplifying channels for each of the two receivers are shown in full. Each channel is identical to that represented by the component 72–83 of FIG. 6 and will not be described in detail. The six input terminals have been identified with the references A1, A2, A3 for one receiver and B1, B2, B3 for the other.

The band pass filter 30 of FIG. 6 has, however, been replaced by active filters 101, 102, 103 and 104, 105, 106 which have the advantage of a sufficiently low impedence to allow the gain controlled amplifier stage 31 of FIG. 6 to be dispensed with. The filters 101, 102, 103, 104, 105, 106 thus feed directly into the rectifier stage identified with the same reference numeral, 32, as the corresponding stage in the embodiment of FIG. 6 and this rectifier stage feeds a comparator 93 corresponding to the identically reference comparator of FIG. 6 with the exception that the low impedence filters 101–106 allow the use of high precision components in the rectifier stage 32 avoiding the necessity for the variable resistors 91, 92. The output signal from the comparator 93 is fed to an output terminal 98 as before.

What is claimed is:

1. A security system having detector means sensitive to the proximity of at least one detected object, the detector means being operable to generate an alarm indication if the detected object is located in a first region in the vicinity of the detector means and inhibited from producing an alarm indication if the detected object is in a second region in the vicinity of the detector means, wherein said detected object is itself sensitive to a physical phenomenon and is operative to cause the production of signals to which the detector is sensitive in response thereto.

2. The security system of claim 1, in which the physical phenomenon is one of moisture, temperature and pressure.

3. The security system of claim 1, in which the detected object is a transmitter operable to transmit signals only when immersed in water or saturated sufficiently to complete an electrical circuit.

4. The security system of claim 3, in which the detector means include two sensors at spaced locations and the first and second regions are determined by the relationship between the relative positions of the sensors and the relative sensitivity of respective channels through which signals generated thereby are processed.

5. The security system of claim 4, in which the sensors are magnetic induction pick-ups and the transmitter is a resonated magnetic inductor.

6. The security system of claim 5, in which each magnetic induction pick-up includes three magnetic inductors mutually orthogonally orientated and means for producing an output signal in response to signals induced in any one or any combination of inductors.

7. The security system of claim 4, in which a first sensor channel generates a first maximum (saturated) output signal when the transmitter is within a first radial distance therefrom and the second sensor channel generates a second maximum output signal when the transmitter is within a second radial distance therefrom, the said first maximum output signal being greater than the said second maximum output signal and the sensitivity of the said second sensor channel being greater than that of the first sensor channel.

8. The security system of claim 3, in which the transmitter acts to radiate electromagnetic signals at a frequency lower than about 300 KHz.

9. The security system of claim 8, in which the transmitter includes an electromagnetic inductor tuned to a carrier frequency between about 30 KHz and about 100 KHz.

10. The security system of claim 1, for maritime use, in which the said alarm indication triggers launching of a safety buoy.

11. A security system having detector means sensitive to the proximity of at least one detected object, the detector means being operable to generate an alarm indication if the detected object is located in a first region in the vicinity of the detector means and inhibited from producing an alarm indication if the detected object is in a second region in the vicinity of the detector object is in a second region in the vicinity of the detector means, wherein the detector means include two sensors at spaced locations and the first and second regions are determined by the relationship between the relative positions of the sensors and the relative sensitivity of respective channels through which signals generated thereby are processed.

12. The security system of claim 11, in which the sensors are magnetic induction pick-ups and the transmitter is a resonated magnetic inductor.

13. The security system of claim 12, in which each magnetic induction pick-up includes three magnetic inductors mutually orthogonally orientated and means for producing an output signal in response to signals induced in any one or any combination of inductors.

14. The security system of claim 11, in which a first sensor channel generates a first maximum (saturated) output signal when the transmitter is within a first radial distance therefrom and the second sensor channel generates a second maximum output signal when the transmitter is within a second radial distance therefrom, the said first maximum output signal being greater than the said second maximum output signal and the sensitivity of the said second sensor channel being greater than that of the first sensor channel.

* * * * *